US009259918B2

(12) United States Patent
Komatsu et al.

(10) Patent No.: US 9,259,918 B2
(45) Date of Patent: Feb. 16, 2016

(54) LIQUID DISCHARGE APPARATUS AND LIQUID DISCHARGE STATE DETECTING METHOD

(71) Applicant: SEIKO EPSON CORPORATION, Tokyo (JP)

(72) Inventors: Shinya Komatsu, Nagano (JP); Kenji Otokita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/601,897

(22) Filed: Jan. 21, 2015

(65) Prior Publication Data

US 2015/0202872 A1 Jul. 23, 2015

(30) Foreign Application Priority Data

Jan. 23, 2014 (JP) ..... 2014-010153

(51) Int. Cl.
*B41J 2/045* (2006.01)
*B41J 2/14* (2006.01)

(52) U.S. Cl.
CPC ..... *B41J 2/0451* (2013.01); *B41J 2/04581* (2013.01); *B41J 2/14274* (2013.01); *B41J 2002/14354* (2013.01)

(58) Field of Classification Search
CPC .. B41J 2/04581; B41J 2/04588; B41J 29/393; B41J 2/04541; B41J 2/16579
USPC ..... 347/19, 68, 70–72
See application file for complete search history.

(56) References Cited

U.S. PATENT DOCUMENTS

| | | | | |
|---|---|---|---|---|
| 8,371,675 | B2 * | 2/2013 | Shinkawa | 347/19 |
| 2005/0122360 | A1 | 6/2005 | Sakagami et al. | |
| 2011/0234663 | A1 | 9/2011 | Ohhashi | |

FOREIGN PATENT DOCUMENTS

| | | | |
|---|---|---|---|
| JP | 2006-218872 | A | 8/2006 |
| JP | 2008-188840 | A | 8/2008 |
| JP | 2010-208217 | A | 9/2010 |
| JP | 2012-140019 | A | 7/2012 |
| JP | 2013-103464 | A | 5/2013 |

* cited by examiner

*Primary Examiner* — An Do
(74) *Attorney, Agent, or Firm* — Global IP Counselors, LLP

(57) ABSTRACT

An ink jet printer is provided with discharge heads configured to discharge ink which is filled into a cavity from a nozzle which is linked with a cavity due to the capacity of the cavity changing according to vibrating of a vibration plate which is vibrated by a piezoelectric element, a head driver configured to drive the piezoelectric element, and a detecting section configured to detect the state of the discharge heads. The detecting section is configured to detect the state of the discharge heads within a specific period of time after driving of the piezoelectric element is stopped.

8 Claims, 9 Drawing Sheets

LIQUID DISCHARGE APPARATUS AND LIQUID DISCHARGE STATE DETECTING METHOD

CROSS-REFERENCE TO RELATED APPLICATIONS

This application claims priority to Japanese Patent Application No. 2014-010153 filed on Jan. 23, 2014. The entire disclosure of Japanese Patent Application No. 2014-010153 is hereby incorporated herein by reference.

BACKGROUND

1. Technical Field

The present invention relates to a liquid discharge apparatus and a liquid discharge state detecting method.

2. Related Art

Technological improvements with regard to ink jet printers which are liquid discharge apparatuses are progressing and it is possible to record (print) in various formats with regard to various recording (printing) media. As a result, it is popular to use ink jet printers as medium scale printers for commercial applications which correspond to creating posters, signage, promotional materials, packaging, and the like and large scale printers for industrial application where the printers are built into product manufacturing lines. In accompaniment with this, greater reliability in these printers is demanded so that it is possible to stably perform high quality recording (printing) over a long period of time.

With regard to this, for example, an ink jet recording apparatus is described in Japanese Unexamined Patent Application Publication No. 2008-188840 which, with the object of it being possible to more efficiently maintain ink discharge characteristics, measures time elapsed since an operation of ejecting ink from a recording head, detects a recording head discharge state using a detecting means in a case where the elapsed time exceeds a threshold time interval, and performs a discharge head recovery operation using a recovery means when it is detected that there is a problem with the discharge state.

However, there is a problem in the ink jet recording apparatus described in Japanese Unexamined Patent Application Publication No. 2008-188840 in that, in checking of the discharge state which is performed in a case where the elapsed time exceeds the threshold time interval, there are cases where it is not possible to detect discharge abnormalities due to the timing with which the checking is carried out. In detail, even though a discharge abnormality is generated due to, for example, bubbles which are included in the discharge head (a cavity), there are cases such as where the bubbles which are the cause of the discharge abnormality dissipate or become a size which is less than the limit for detection in a brief period until the timing when a checking means performs checking and it is not possible to detect discharge abnormalities and the like. That is, there is a problem in that it is not possible to precisely detect the state of the discharge head when the period of time from when printing is stopped to the start of checking is long.

SUMMARY

The present invention is carried out in order to solve the problems described above and is able to be realized as the following applied examples or embodiments.

A liquid discharge apparatus according to the present applied example is provided with a discharge section configured to discharge a liquid which is filled into a cavity from a nozzle linked with cavity, due to the capacity of the cavity changing according to vibrating of a vibration plate which is vibrated by a piezoelectric element, a driving section configured to drive the piezoelectric element, and a detecting section configured to detect a state of the discharge section. The detecting section is configured to detect the state of the discharge section within a specific period of time after driving of the piezoelectric element is stopped.

According to the present applied example, in a case where any fault is generated in the discharge section when the piezoelectric element is being driven, it is possible to detect the state within a certain range over which the circumstances of the fault change since the state of the discharge section is detected within a specific period of time after driving of the piezoelectric element is stopped. As a result, it is possible to more precisely detect the state of the discharge section.

In the liquid discharge apparatus according to the applied example described above, the specific period of time is a period of time over which a volume of a bubble which is included in the cavity while the driving section is driving the piezoelectric element is reduced by half after driving of the piezoelectric element is stopped.

According to the present applied example, it is possible to precisely detect abnormalities which are generated in the discharge section prior to this state dissipating.

A liquid discharge apparatus according to the present applied example is provided with a discharge section configured to discharge a liquid which is filled into a cavity from a nozzle linked with the cavity, due to capacity of the cavity changing according to vibrating of a vibration plate which is vibrated by a piezoelectric element, a driving section configured to drive the piezoelectric element, and a detecting section configured to detect the state of the discharge section. The detecting section is configured to detect the state of the discharge section within a specific period of time after the discharge section discharges the liquid.

According to the present applied example, in a case where any fault is generated in the discharge section while the discharge section is discharging the liquid, it is possible to detect the state within a certain range over which the circumstances of the fault change since the state of the discharge section is detected within a specific period of time after the discharge section discharges the liquid. As a result, it is possible to more precisely detect the state of the discharge section.

In the liquid discharge apparatus according to the applied example described above, the specific period of time is a period of time over which a volume of a bubble which is included in the cavity while the discharge section is discharging the liquid is reduced by half after the discharge section discharges the liquid.

According to the present applied example, it is possible to precisely detect abnormalities which are generated in the discharge section prior to this state dissipating.

In the liquid discharge apparatus according to the applied example described above, it is preferable that the specific period of time be 30 seconds.

Due to the detecting section detecting the state of the discharge section within 30 seconds after driving of the piezoelectric element is stopped or the discharge section discharges the liquid as in the present applied example, it is possible to more precisely detect the state of the discharge section since it is easy to detect the state of the discharge section before the abnormality which is generated in the discharge section dissipates.

In the liquid discharge apparatus according to the applied example described above, the detecting section is configured to detect the state of the discharge section based on residual vibration in the vibration plate.

According to the present applied example, it is possible to simply estimate the extent of the bubbles which are included in the cavity by observing the residual vibration in the vibration plate. By observing the residual vibration in the vibration plate, it is possible to more simply perform detecting of the state of the discharge section (in particular, a state where bubbles have an effect) within a specific period of time after driving of the piezoelectric element is stopped or the discharge section discharges the liquid.

The liquid discharge apparatus according to the applied example described above further comprises a recording medium moving section configured to move a recording medium, and the detecting section is configured to start detecting the state of the discharge section while the recording medium moving section is moving the recording medium.

According to the present applied example, since the liquid discharge apparatus starts detecting the state of the discharge section before moving of the recording medium is complete, it is possible for it to be easy to detect the state of the discharge section before the abnormality which is generated in the discharge section dissipates.

In the liquid discharge apparatus according to the applied example described above, the discharge section is further configured to move between a first region where the liquid is discharged onto the recording medium where the liquid is discharged and a second region where the liquid is not discharged onto a recording medium, and the detecting section is configured to start detecting the state of the discharge section while the discharge section is positioned in the first region.

According to the present applied example, since the liquid discharge apparatus starts detecting the state of the discharge section in the first region after the discharge section discharges the liquid in the first region, it is possible for it to be easy to detect the state of the discharge section before the abnormality which is generated in the discharge section dissipates.

The liquid discharge apparatus according to the applied example described above further comprises a discharge section moving section configured to move the discharge section, and the detecting section is configured to start detecting the state of the discharge section while the discharge section moving section is moving the discharge section.

According to the present applied example, since the state of the discharge section is detected before moving of the discharge section is complete, it is possible for it to be easy to detect the state of the discharge section before the abnormality which is generated in the discharge section dissipates.

A liquid discharge state detection method according to the present applied example where a state of a discharge section is detected in a liquid discharge apparatus which includes the discharge section configured to discharge a liquid which is filled into a cavity from a nozzle linked with the cavity, due to capacity of the cavity changing according to vibrating of a vibration plate which is vibrated by a piezoelectric element, and a driving section configured to drive the piezoelectric element, comprises detecting a state of the discharge section within a specific period of time after driving of the piezoelectric element is stopped.

In the liquid discharge state detecting method of the present applied example, in a case where any fault is generated in the discharge section while the piezoelectric element is being driven, it is possible to detect the state within a certain range over which the circumstances of the fault change since the state of the discharge section is detected within a specific period of time after driving of the piezoelectric element is stopped. As a result, it is possible to more precisely detect the state of the discharge section.

A liquid discharge state detection method according to the present applied example where a state of a discharge section is detected in a liquid discharge apparatus which includes the discharge section configured to discharge a liquid which is filled into a cavity from a nozzle linked with the cavity, due to capacity of the cavity changing according to vibrating of a vibration plate which is vibrated by a piezoelectric element, and a driving section configured to drive the piezoelectric element, comprises detecting a state of the discharge section within a specific period of time after the discharge section discharges the liquid.

In the liquid discharge state detecting method of the present applied example, in a case where any fault is generated in the discharge section while the piezoelectric element is being driven, it is possible to detect the state within a certain range over which the circumstances of the fault change since the state of the discharge section is detected within a specific period of time after the discharge section discharges the liquid. As a result, it is possible to more precisely detect the state of the discharge section.

BRIEF DESCRIPTION OF THE DRAWINGS

Referring now to the attached drawings which form a part of this original disclosure:

FIG. 7 is a graph comparing waveforms of residual vibration in a normal state and in a state when bubbles are mixed in;

DETAILED DESCRIPTION OF EXEMPLARY EMBODIMENTS

A specific embodiment of the present invention will be described below with reference to the drawings. Below is an embodiment of the present invention but the present invention is not limited to this. Here, there are cases in each of the following drawings where the dimensions are drawn to be different to the actual dimensions in order for the description to be easy to understand.

Embodiment 1

Figure 1A:
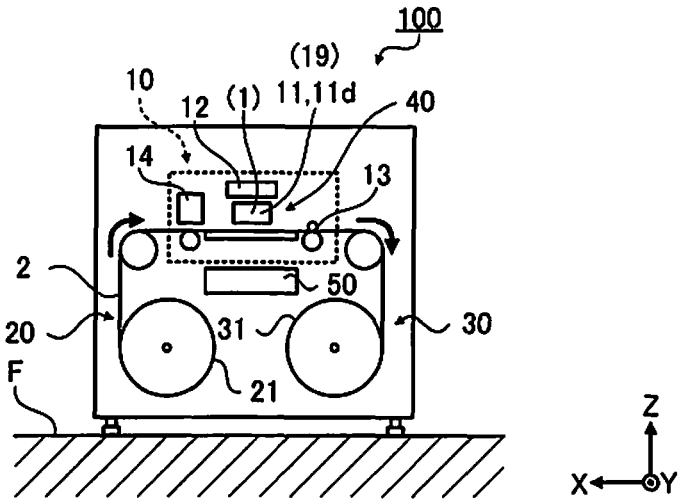
FIG. 1A is a front surface diagram schematically illustrating a liquid discharge apparatus according to embodiment 1.
Figure 1B:
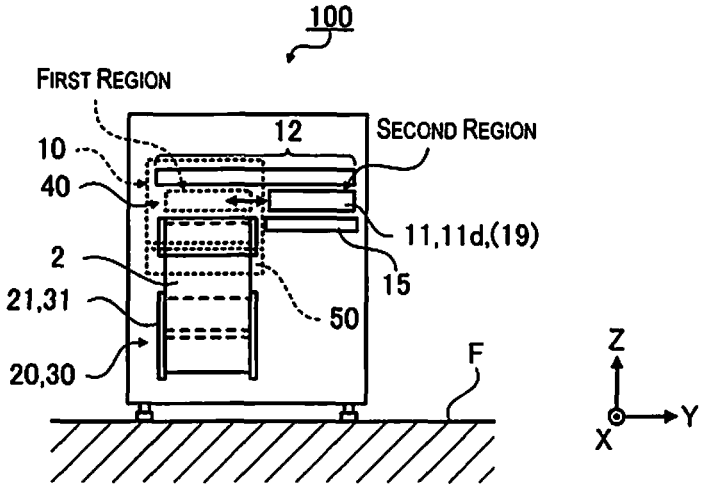
FIG. 1B is a side surface diagram schematically illustrating the liquid discharge apparatus according to embodiment 1.

FIG. 1A is a front surface diagram and FIG. 1B is a side surface diagram which schematically illustrate an ink jet printer 100 which is a liquid discharge apparatus according to embodiment 1.

In FIGS. 1A and 1B, the Z axis direction is the up and down direction and the −Z direction is the downward direction, the Y axis direction is the forward and backward direction and the +Y direction is the forward direction, the X axis direction is the left and right direction and the +X direction is the leftward direction, and the X-Y plane is a surface which is parallel with a floor F on which the ink jet printer 100 is arranged.

The ink jet printer 100 is an ink jet printer which records an image on a paper roll 2 which is a "recording medium" which is supplied in a state of being wound in a roll form by discharging an ink 1 which is a "liquid", and is configured from a recording section 10, a supply section 20, a housing section 30, a detecting section 40, a control section 50, and the like.

For example, an ultraviolet curable ink, which is able to be cured by irradiating ultraviolet rays, is used as the ink 1. An ultraviolet irradiating means is provided in the ink jet printer 100 for curing (or provisionally curing) the ink 1, but description of the ultraviolet irradiating means is omitted.

The recording section 10 is a portion which forms (records) an image on the paper roll 2 according to image information which is provided by the control section 50, and is provided with discharge heads 11 which are a "discharge section" which discharges the ink 1 onto the surface of the paper roll 2, a head driver 11*d* which is a "driving section" which drives the discharge heads 11, a head moving mechanism 12, a driving roller 13 which is a "recording medium moving section", an ink tank 14, and the like.

A plurality of the discharge heads 11 are provided for each type of the ink 1 which is discharged and one head unit 19 (which will be described later) is configured by the plurality of discharge heads 11 which discharge the same type of the ink 1. As types of the ink 1, for example, yellow, magenta, cyan, black, clear, and the like are used. Accordingly, the discharge section is configured by five of the head units 19 in this case. Here, the discharge heads 11 (the head units 19) are aligned to be fixed in the width direction of the paper roll 2 and configure a printer with a so-called line head system. The configuration of the discharge heads 11 will be described later.

The head moving mechanism 12 supports the discharge heads 11 (the head units 19) such that it is possible to move between a first region and a second region which is separate from the first region in the Y direction as shown in FIG. 1B under control of the control section 50.

The first region is a region which is positioned above the paper roll 2 which is supported on a transfer path and where the ink 1 is discharged onto the paper roll 2 using the discharge heads 11 and an image is formed.

The second region is a region which is positioned on the Y side of the first region and where discharge cleaning such as flushing or maintenance is performed. An ink recovery section 15 which receives and recovers the ink 1 which is discharged from the discharge heads 11 is provided in the second region.

The driving roller 13 transfers (moves) the paper roll 2 in a transfer direction which is the −X direction (a first direction) by being rotated by a drive motor (which is not shown in the drawings) which is driven to accompany forming of an image under control of the control section 50. The driving roller 13 moves the paper roll 2 when the ink 1 is being discharged and when the ink 1 is not being discharged.

The ink tank 14 retains the ink 1. The ink 1 which is retained in the ink tank 14 is supplied to the discharge heads 11 using an ink supply path 80 (which will be described later). The ink tank 14 and the ink supply path 80 which is linked to the ink tank 14 are independently provided for each type of the ink 1.

The supply section 20 is a recording medium supply section which houses the paper roll 2 prior to recording, is positioned on the upstream side of the recording section 10 in the transfer path of the paper roll 2, and is provided with a feeding reel 21 or the like on which the paper roll 2 is loaded. The feeding reel 21 feeds the paper roll 2 towards the recording section 10 which is arranged on the downstream side of the supply section 20 by being rotated by a feeding motor (which is not shown in the drawings).

The housing section 30 is a recording medium housing section which winds in and houses the paper roll 2 after recording, is positioned on the downstream side of the recording section 10 in the transfer path of the paper roll 2, and is provided with a winding reel 31 or the like which winds in the paper roll 2. The winding reel 31 winds in the paper roll 2 which is sent via the recording section 10 which is arranged on the upstream side of the housing section 30 by being rotated by a winding motor (which is not shown in the drawings).

Here, the recording medium is described with the paper roll 2 as an example, but the recording medium may be a medium in sheet form. In a case where a medium in sheet form is the target medium, the recording medium supply section is provided with a supply mechanism which includes a separator in order for the recording medium to be supplied one sheet at a time to the recording section 10. In addition, the recording medium housing section is provided with a housing tray or the like for housing the medium which is ejected from the recording section 10 after recording.

Figure 2:
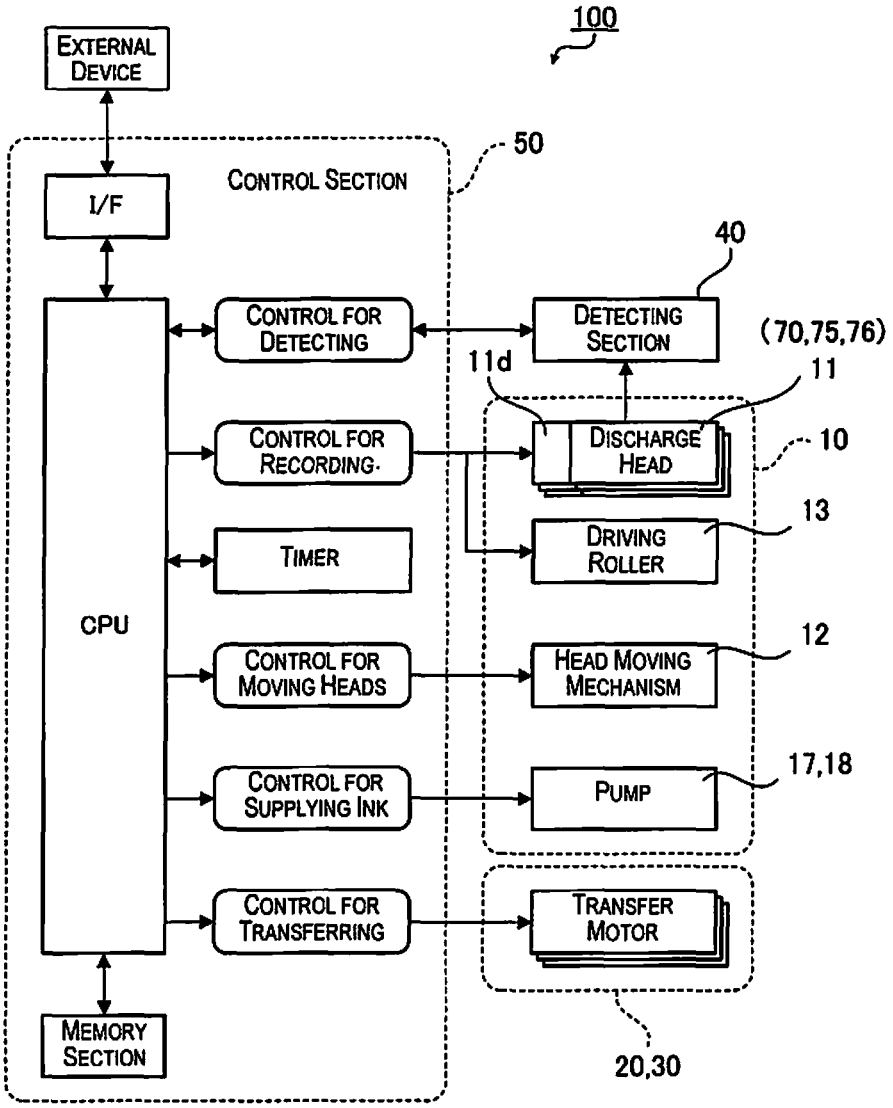
FIG. 2 is a block diagram of the liquid discharge apparatus according to embodiment 1.

FIG. 2 is a block diagram of the ink jet printer 100.

The detecting section 40 is a portion which detects a discharge state by detecting (observing) the state of the ink 1 in the discharge heads 11 and is controlled by the control section 50. The details of the detecting section 40 will be described later.

The control section 50 is a control unit which performs central control of the ink jet printer 100, has a computation unit (a CPU), an interface (I/F) to communicate with an external apparatus, a memory section, a timer, and the like, and performs control for transferring the paper roll 2, control for recording in order to form an image, control for supplying ink to the discharge heads 11, control for detecting the state of the discharge heads 11, control for moving the discharge heads 11, and the like.

The control section 50 receives image information for recording from an external apparatus such as a personal computer or an image processing apparatus in advance via the communication interface (I/F) and stores the information in the memory section.

Control for transferring is performing control of each type of transfer motor in the transfer path which includes the feeding motor, the winding motor, and the like described above, and of a position determining mechanism or a holding mechanism (which are not shown in the drawings) for the paper roll 2, and the like.

Control for recording is control for forming an image and is performing control for discharging the ink 1 with regard to the discharge heads 11 at the same time as controlling the driving roller 13 based on the image information.

Control for supplying ink is performing control for driving a pump 17 which pumps the ink 1 within the ink supply path 80, control of a pump 18 which is a "pressurizing section" where performs control to pressurize the ink 1 within the ink supply path 80, and the like.

Control for moving the discharge heads 11 is control with regard to movement for performing maintenance on the discharge heads 11 (the head units 19) and the like and is performing control of the head moving mechanism 12 in order to move the discharge heads 11 (the head units 19) between the first region and the second region.

Control for detecting is performing control of the detecting section 40 which detects the state of the discharge heads 11.

Figure 3A:
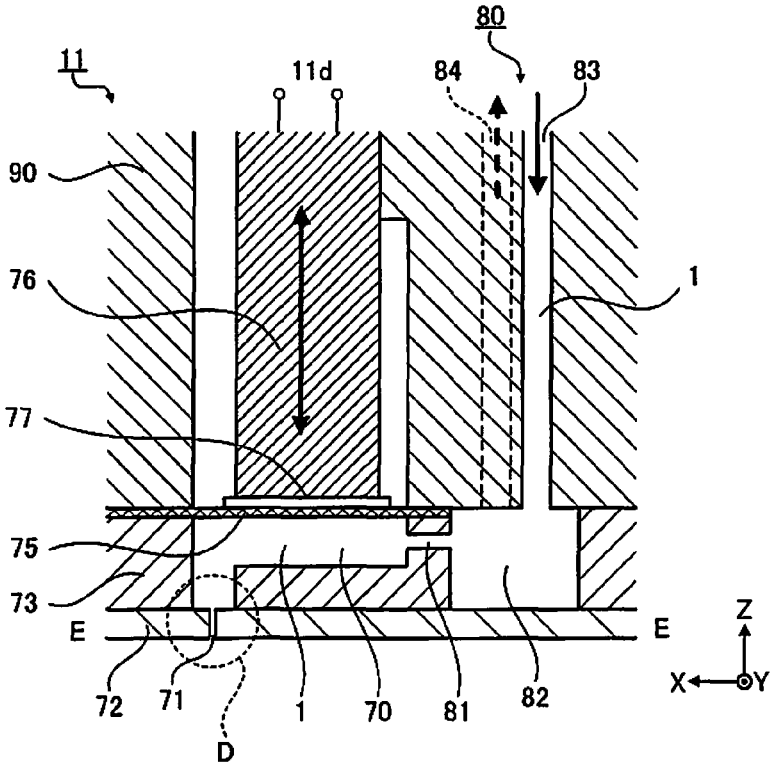
FIG. 3A is a cross sectional diagram schematically illustrating a discharge section (a discharge head)
Figure 3B:
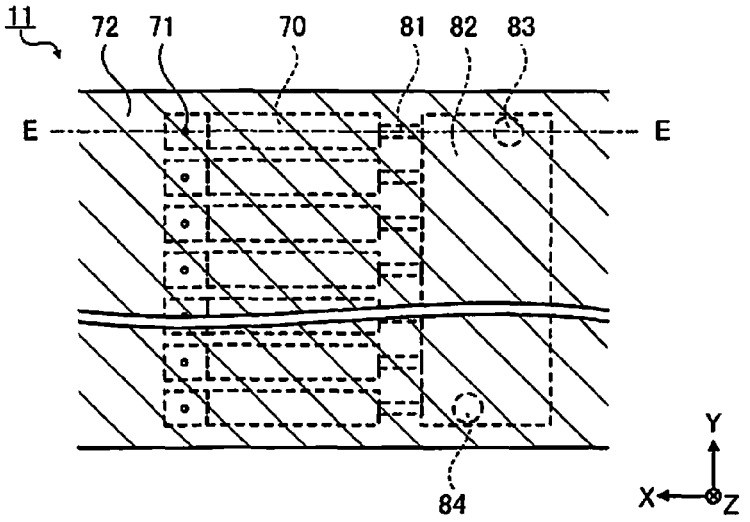
FIG. 3B is planar diagram schematically illustrating the discharge section (the discharge head)

FIG. 3A is a cross sectional diagram and FIG. 3B is planar diagram which schematically illustrate the discharge heads 11 which is the "discharge section". In addition, FIG. 3A is a cross section diagram along E-E of FIG. 3B and FIG. 3B is a planar diagram viewed from the lower surface (in the −Z direction) in FIG. 3A.

The discharge heads 11 are provided with a plurality of cavities 70 which are filled with the ink 1, nozzles 71 which are linked with one lower edge section of each cavity 70 and which discharge the ink 1 which is filled in the cavities 70, a nozzle board 72 on which a plurality of the nozzles 71 are formed, a cavity board 73 on which the plurality of cavities 70 are formed, a vibration plate 75 which configures a ceiling section for the cavities 70, a piezoelectric element 76 which vibrates the vibration plate, a joining plate 77 which joins the vibration plate 75 and the piezoelectric element 76, a head base 90, and the like as a system for discharging the ink 1.

In addition, the discharge heads 11 are provided with linking paths 81 which are linked with the other edge section of the cavities 70, a manifold 82 which supplies the ink 1 to a plurality of the linking paths 81, an ink introduction path 83 which circulates and supplies the ink 1 to the manifold 82, an ink ejection path 84 which circulates and ejects the ink 1 from the manifold, and the like as a system for supplying the ink 1 to the cavities 70.

The cavities 70 are pressure chambers for discharging the ink 1 from the nozzles 71 as ink droplets. The cavities 70 are substantially rectangular cavities which extend in the X axis direction and the plurality of cavities 70 are formed so as to line up in the Y axis direction using the cavity board 73. The edge section on the +X side of the cavities 70 forms a lower region at the edge section of the cavities 70 which extends in the −Z direction and is linked with the nozzles 71.

The nozzles 71 are formed with a plurality of through holes which are lined up in the Y axis direction on the nozzle board 72 which extends in the X-Y plane, the cavities 70 and the nozzles 71 are linked by a region of the nozzle board 72 in which the nozzles 71 are formed abutting with the lower region of the edge section of the cavities 70 which are lined up with the same pitch.

The vibration plate 75 is interposed by the cavity board 73 and the head base 90 so as to configure a ceiling section for the cavities 70.

The piezoelectric element 76 is driven by the head driver 11*d* which is controlled to be driven in accordance with control for recording by the control section 50. The piezoelectric element 76 is housed in the head base 90 and an upper edge region of the piezoelectric element 76 is fixed to the head base 90. A lower edge of the piezoelectric element 76 is joined to the vibration plate 75 via the joining plate 77.

The discharge heads 11 discharge the ink 1 which is filled into the cavities 70 from the nozzles 71 which are linked with the cavities 70 due to the capacity of the cavities 70 changing according to vibrating of the vibration plate 75 which is vibrated by the piezoelectric element 76.

Figure 4:
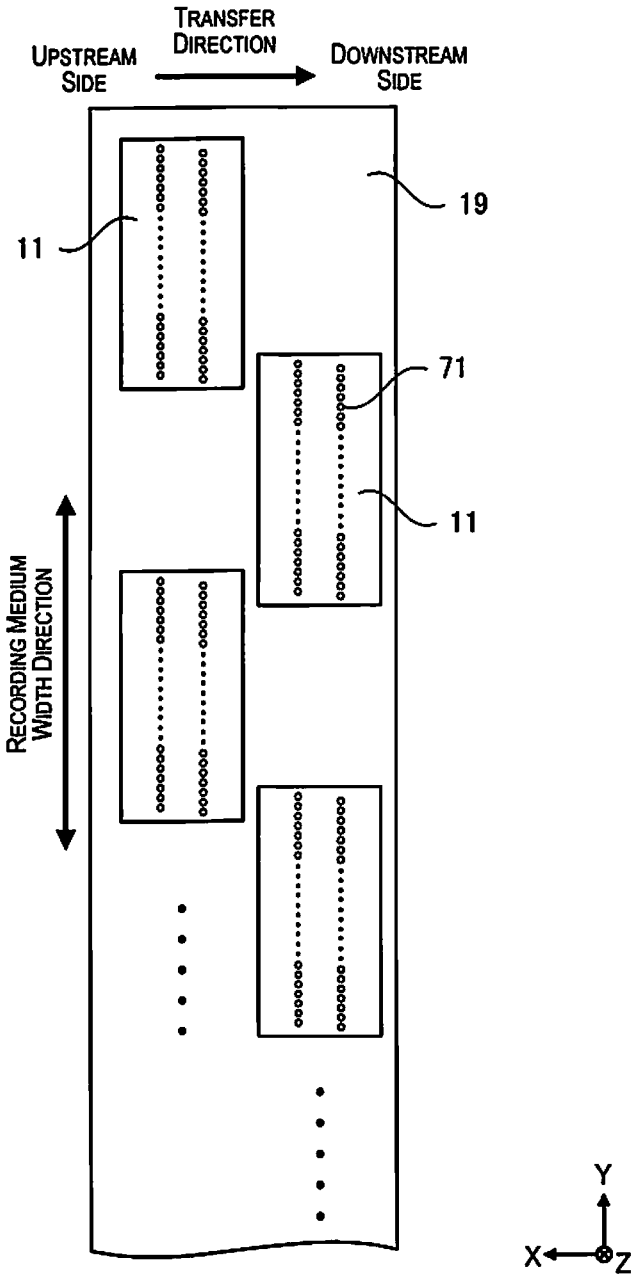
FIG. 4 is a planar diagram illustrating an example of a head unit.

FIG. 4 is a planar diagram illustrating an example of the head unit 19, and the head unit 19 is shown in a state viewed from the lower surface of the head unit 19.

The head unit 19 is provided with a plurality of the discharge heads 11. The plurality of discharge heads 11 are arranged in a zig-zag shape as shown in FIG. 4 so that it is possible to discharge the ink 1 over the entire width direction of the paper roll 2. In addition, two rows of the nozzles 71 are formed in a zig-zag shape in each of the discharge heads 11. Due to this, a nozzle pitch of, for example, 720 dpi is realized in the width direction of the paper roll 2 (a direction which intersects with the transfer direction of the paper roll 2).

Figure 5:
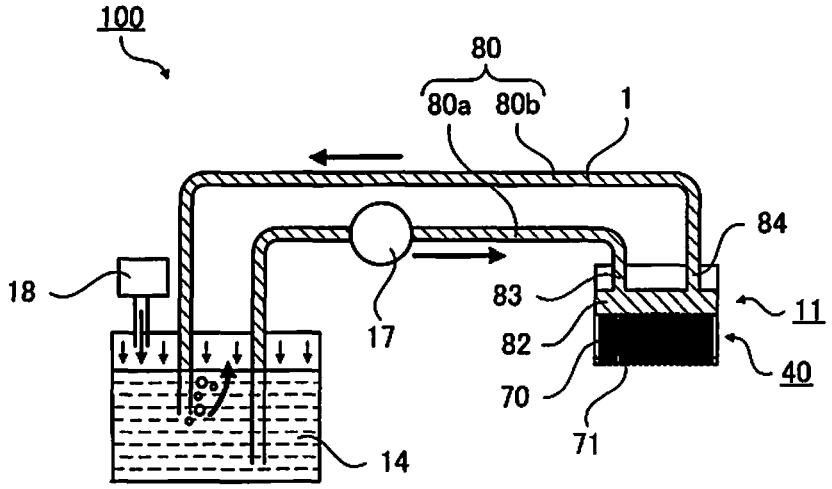
FIG. 5 is schematic diagram illustrating a discharge section (a discharge head) and a liquid supply path.

FIG. 5 is schematic diagram illustrating the discharge heads 11 and the ink supply path 80.

The ink supply path 80 is a supply path which supplies the ink 1 into the plurality of cavities 70 and is configured by a circulation path which has an outward path 80*a* from the ink tank 14 to the manifold 82 (the ink introduction path 83) and a return path 80*b* from the manifold 82 to the ink tank 14 (the ink ejection path 84). In addition, the pump 17 which pumps the ink 1 in the ink supply path 80 is provided in the outward path 80*a*.

It is possible for the pump 17 to change the speed at which the ink 1 is pumped in the ink supply path 80 due to controlling by the control section 50.

As shown in FIG. 5, the ink tank 14 is configured so that the ink 1 is retained in an inner section of the ink tank 14 and the ink 1 in a region where bubbles are not included is sent out to the outward path 80*a*. In addition, the ink tank 14 is provided with the pump 18 which performs control to pressurize the ink 1 in the ink supply path 80.

It is possible for the pump 18 to change the pressure of the ink 1 in the ink supply path 80 due to controlling by the control section 50.

The ink 1 includes a polymerizable compound, a photopolymerization initiator, a pigment, a dispersing agent, a polymerization inhibitor, a surfactant, an additive, and the like.

The polymerizable compound is polymerized by irradiating ultraviolet rays due to the action of the photopolymerization initiator and it is possible to cure the ink 1 which is discharged and applied (printed). As the polymerizable compound, it is possible to use various types of monomers or oligomers which are polyfunctional such as monofunctional, bifunctional, or trifunctional monomers or oligomers which are known in the prior art. As the monomers described above, there are the examples of, for example, unsaturated carboxylic acids such as (meth)acrylic acid, itaconic acid, crotonic acid, isocrotonic acid, and maleic acid or the salts thereof, esters, urethanes, amides, or the anhydrides thereof, acrylonitriles, styrenes, unsaturated polyesters, unsaturated polyethers, unsaturated polyamides, and unsaturated urethanes. In addition, as the oligomers described above, there are the examples of, for example, oligomers which are formed from the monomers described above such as straight chain acrylic oligomers, epoxy(meth)acrylates, oxetane(meth)acrylates, vinyl ether group-containing (meth)acrylates, aliphatic urethane(meth)acrylates, aromatic urethane (meth)acrylates, and polyester(meth)acrylates.

The photopolymerization initiator is used in order to cure the ink 1 which is on the surface of the recording (printing) medium due to photopolymerization by irradiating ultraviolet rays. By using ultraviolet (UV) rays as the light, it is possible to have superior safety and suppress cost of the lamp which is the light source. The photopolymerization initiator is not limited as long as an active species such as a radial or a cation is generated using the energy of the ultraviolet rays and polymerization of the polymerizable compound is initiated, it is possible to use a photo-radial polymerization initiator or a photo-cation polymerization initiator, and it is preferable that a photo-radial polymerization initiator be used. As the radial polymerization initiator, there are the examples of, for example, aromatic ketones, acyl phosphine oxide compounds, aromatic onium salt compounds, organic peroxides, thio compounds (thioxanthone compounds, thiophenyl group-containing compounds, and the like), hexaaryl biimidazole compounds, ketoxime ester compounds, borate compounds, azinium compounds, metallocene compounds, active ester compounds, compounds with a carbon-halogen bond, and alkyl amine compounds.

It is possible for either inorganic pigments or organic pigments which are colorants to be used as the pigment.

As the inorganic pigment, it is possible to use types of carbon black (C.I. pigment black 7) such as furnace black, lamp black, acetylene black, and channel black, iron oxide, and titanium oxide.

As the organic pigment, there are the examples of azo pigments such as insoluble azo pigments, condensed azo pigments, azo lake, and chelate azo pigments, polycyclic pigments such as phthalocyanine pigments, perylene or perynone pigments, anthraquinone pigments, quinacridone pigments, dioxane pigments, thioindigo pigments, isoindoline pigments, and quinophthalone pigments, dye chelates (for example, basic dye chelates and acidic dye chelates), color lakes (basic dye lake and acidic dye lake), nitro pigments, nitroso pigments, aniline black, and fluorescent pigments.

There are no particular limits with regard to the dispersing agent and there are the examples of, for example, dispersing agents which are commonly used in preparing pigment dispersant solutions such as a polymer dispersing agent. As specific examples, there are the examples of a compound where the main component is one or more out of polyoxyalkylene polyalkylene polyamines, vinyl polymers or copolymers, acrylic polymers and copolymers, polyesters, polyamides, polyimides, polyurethanes, amino-based polymers, silicon-containing polymers, sulfur-containing polymers, fluorine-containing polymers, and epoxy resins. As commercially available polymer dispersing agents, there are the examples of the AJISPER series (product name) from Ajinomoto Fine-Techno Co., Inc., the SOLSPERSE series (SOLSPERSE 3200, 36000 and the like (all product names)) from Avecia Inc., the DISPERBYK series (product name) from BYK-Chemie GmbH, and the DISPARLON series (product name) from Kusumoto Chemicals, Ltd.

As the polymerization inhibitor, there is the example of, for example, phenol-based polymerization inhibitors. There are no limits with regard to the phenol-based polymerization inhibitors and there are the examples of, for example, p-methoxyphenol, cresol, t-butyl catechol, di-t-butyl p-cresol, hydroquinone monomethyl ether, α-naphthol, 3,5-di-t-butyl-4-hydroxy toluene, 2,6-di-t-butyl-4-methyl phenol, 2,2'-methylene-bis(4-methyl-6-t-butyl phenol), 2,2'-methylene-bis(4-ethyl-6-butyl phenol), and 4,4'-thio-bis(3-methyl-6-t-butyl phenol).

As the surfactant, it is possible to use, for example, polyester-modified silicone and polyether-modified silicone as silicone-based surfactants and it is particularly preferable to use polyether modified polydimethyl siloxane or polyester modified polydimethyl siloxane. As commercial products of a slipping agent, examples such as BYK-347, BYK-348, and BYK-UV3500, 3510, 3530, and 3570 (all manufactured by BYK-Chemie GmbH) are possible.

As the additive, a polymerization accelerating agent, a penetration enhancing agent, a wetting agent, and other additives which are known in the prior art are possible. As the other additives, there are the examples of, for example, a fixing agent, an anti-mold agent, a preserving agent, an oxidation preventing agent, a UV absorbing agent, a chelating agent, a pH adjusting agent, and a thickening agent which are known in the prior art.

In the ink jet printer 100 with this configuration, there are cases where it is no longer possible to normally discharge ink droplets from the discharge heads 11 due to reasons such as the ink 1 running out, increased ink viscosity, bubbles being generated in the ink supply path 80 or in the cavities 70, and clogging of the nozzles 71, and recording quality is reduced due to missing dots and the like in a recording image as a result. It is necessary to perform checking of the liquid discharge state in order to detect such abnormalities.

In the ink jet printer 100, a method for observing the state in the cavities 70 is used as the method for performing checking of the liquid discharge state. The piezoelectric elements 76 which correspond to each of the nozzles 71 are driven by the head driver 11*d* and there is residual vibration in the cavities 70 (the vibration plate 75) after moving (vibrating) of the vibration plate 75 for discharging ink droplets is complete. A method is used where the state in each of the nozzles 71 and the cavities 70 is detected from the state of the residual vibration.

Figure 6:
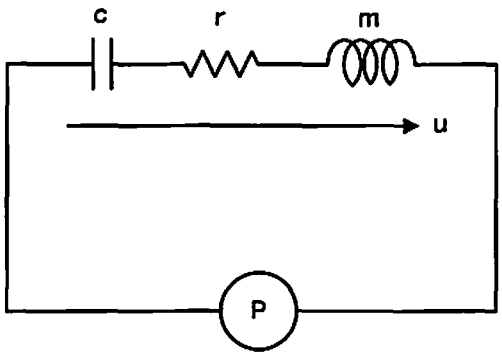
FIG. 6 is an equivalent circuit diagram of simple vibration which is assumed as residual vibration in a vibration plate.

FIG. 6 is an equivalent circuit diagram of simple vibration which is assumed as residual vibration in the vibration plate 75.

P is the pressure which is imparted to the ink 1 in the cavities 70, m is the inertance of the ink 1 in the cavities 70 and the nozzles 71, c is the compliance of the vibration plate 75, r is the flow path resistance, and u is the volumetric speed as a step response when the pressure P is imparted.

Free vibration (residual vibration) with regard to the vibration (movement) of the vibration plate 75 is given by the calculation model shown below in equation 1.

$$u = \frac{P}{\omega \cdot m} e^{-\omega t} \cdot \sin \omega t \tag{1}$$

$$\omega = \sqrt{\frac{1}{m \cdot C} - \alpha^2} \tag{2}$$

$$\alpha = \frac{r}{2m} \tag{3}$$

A case where bubbles are included in the cavity 70 will be described as an example of detecting the state in the cavities 70.

Figure 7:
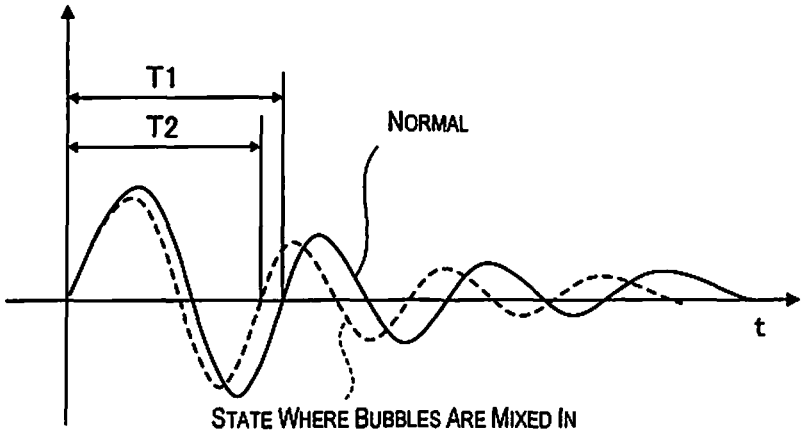
Figure 8:
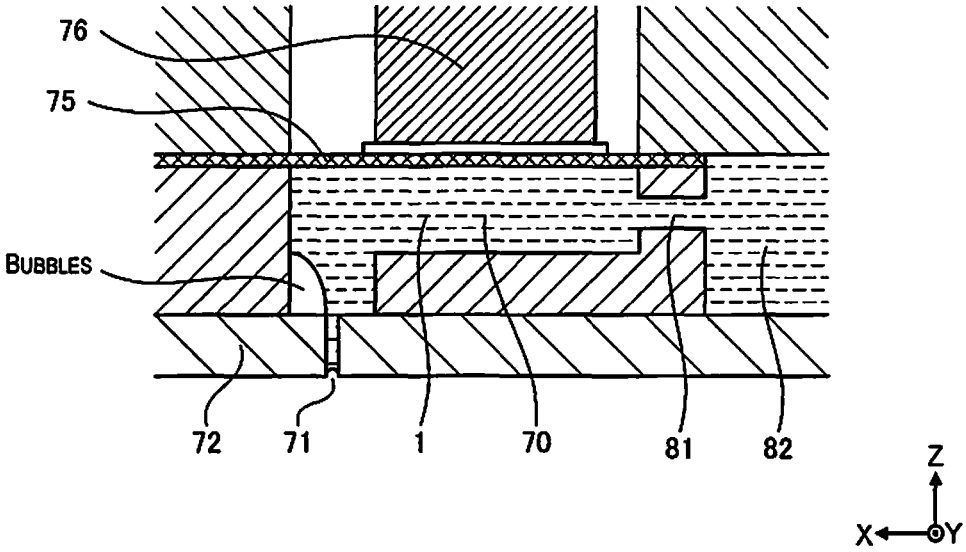
FIG. 8 is a conceptual diagram illustrating a state where bubbles are mixed in a cavity.

FIG. 7 is a graph comparing waveforms of residual vibration (residual waveforms) in a normal state and in a state when bubbles are mixed in. The horizontal axis of the graph expresses time and the vertical axis expresses the size of the residual vibration. In addition, FIG. 8 is a conceptual diagram illustrating a state where a bubble is mixed in the cavity 70. As shown in FIG. 8, in a case where a bubble is mixed in the cavity 70, the inertance m is reduced due to the total amount of the ink 1 which is filled into the cavity 70 is reduced and it is thought that the flow path resistance r is reduced to the same extent as the size of the diameter of the bubble.

As a result, the residual waveform in a case where a bubble is mixed in the cavity 70 increases the frequency of the vibration (f2=1/T2) compared to the normal state as shown in the graph in FIG. 7. Accordingly, it is possible to detect the extent to which air is mixed in the cavity 70 by observing the frequency of the residual vibration in the vibration plate 75.

Figure 9:
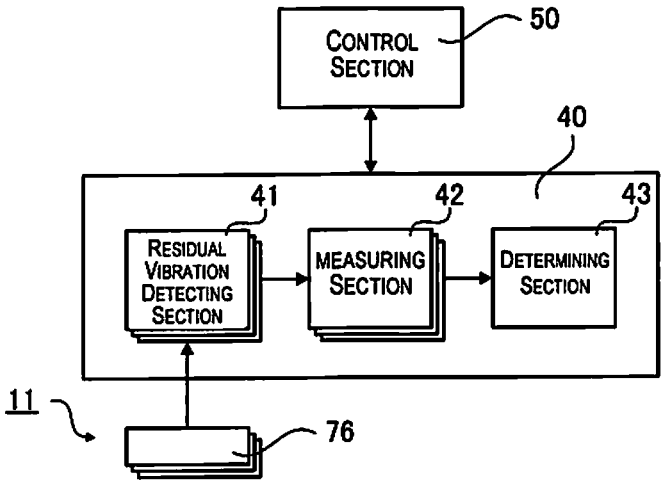
FIG. 9 is a block diagram of a detecting section.

FIG. 9 is a block diagram for describing the detecting section 40.

The detecting section 40 is a portion which detects the state of the cavities 70 by observing the residual vibration in the vibration plate 75 and is configured from a residual vibration detecting section 41, a measuring section 42, a determining section 43, and the like. The residual vibration detecting section 41 and the measuring section 42 are provided together with regard to each of the individual nozzles 71.

Figure 10:
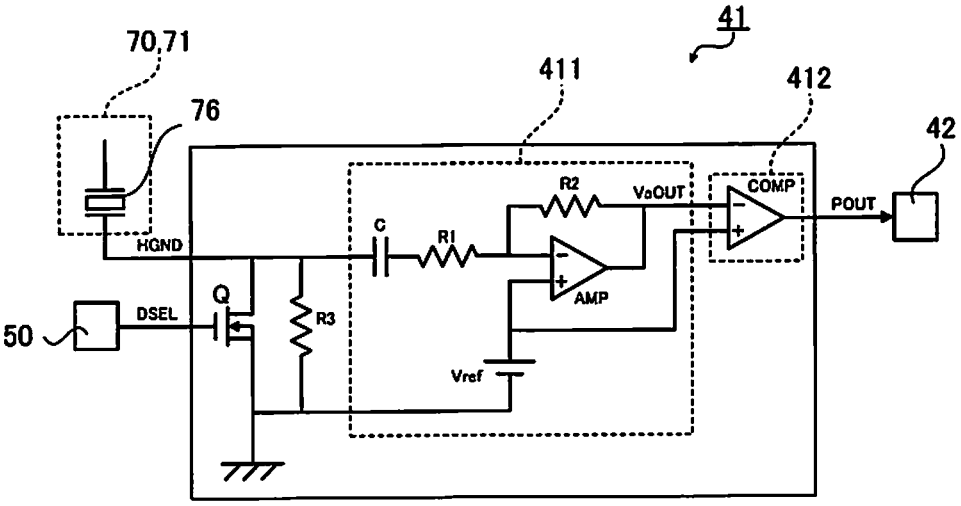
FIG. 10 is a circuit diagram illustrating an example of a residual vibration detection section.

FIG. 10 is a circuit diagram illustrating an example of the residual vibration detection section 41.

The residual vibration detecting section 41 is a portion which detects residual vibration using changes in pressure in the ink 1 in the cavities 70 being transferred to the piezoelectric element 76. In detail, the residual vibration detecting section 41 detects changes in electromotive force (electromotive pressure) which are generated due to the mechanical displacement of the piezoelectric element 76.

The residual vibration detecting section 41 is configured so as to include a transistor Q, an AC amplifier 411, a comparator 412, and the like.

The transistor Q is a switch which grounds or opens a ground terminal (an HGND application side) of the piezoelectric element 76 and a gate voltage (a gate signal DSEL) of the transistor Q is controlled by the control section 50. A resistor R3 is provided in order to suppress rapid changes in voltage during switching the transistor Q between on and off.

The AC amplifier 411 is configured by a capacitor C which removes a DC component and a computing unit AMP which reverses and amplifies with an amplification factor which is determined using resistors R1 and R2 with the potential of a reference voltage Vref at as reference. The AC amplifier 411 amplifies the AC component of the residual vibration which is generated due to opening of the ground terminal after a pulse of a drive signal is applied to the piezoelectric element 76.

The comparator 412 is a comparator, which compares a residual vibration VaOUT which is amplified and the reference voltage Vref, and outputs a pulse POUT at a period according to the residual vibration.

When the gate signal DSEL is at a high level, the transistor Q is on, the ground terminal of the piezoelectric element 76 is in a grounded state, and the drive signal is supplied to the piezoelectric element 76. Alternatively, when the gate voltage (the gate signal DSEL) of the transistor Q is at a low level, the transistor Q is off and the electromotive force of the piezoelectric element 76 is transmitted to the residual vibration detecting section 41.

The residual vibration detecting section 41 outputs the pulse POUT to the measuring section 42 at a period according to the residual vibration VaOUT where an electromotive force signal is amplified depending on the residual vibration.

The description will return to FIG. 9.

The measuring section 42 is an A/D converting section which measures the period of the pulse POUT at a period according to the residual vibration and transmits a measurement value to the determining section 43.

The determining section 43 collects and evaluates the measurement values of the residual vibration under the control of the control section 50 and detects the state in the cavities 70. In detail, it is determined that there is an abnormality in the cavities 70 in a case where residual vibration is observed at a frequency which exceeds a specific threshold compared to the frequency of the residual vibration which is obtained in a normal state. The determining section 43 transmits the results of detecting the state in the cavities 70 to the control section 50.

Here, there may be a configuration where the function of the determining section 43 is provided in the control section 50 and the control section 50 evaluates the state in the cavities 70. That is, there may be a configuration where measurement results from the measuring section 42 are collected by the control section 50 and the state in the cavities 70 is detected by the control section 50 evaluating the measurement values of the residual vibration.

In this manner, it is possible to detect the state of ink droplet discharging by observing the residual vibration in the cavities 70 using the detecting section 40, but there are cases where it is not possible to detect this state even though there is a discharge abnormality while the ink jet printer 100 is being operated (discharging ink droplets and recording on the paper roll 2) depending on the timing when the state is observed using the detecting section 40. When a discharge abnormality due to a bubble which is generated in the cavity 70 is described in detail as an example, pressure of the ink 1 in the cavity 70 repeatedly increases and decreases in a state where the vibration plate 75 repeatedly vibrates. Since there are cases where bubbles expand in a state where the pressure is reduced, it is difficult for bubbles which are included in an inner section of the cavity 70 to dissipate as a result. Accordingly, it is difficult for bubbles which are included in an inner section of the cavity 70 to dissipate during a recording operation and there are cases where discharging is affected. In addition, there is a tendency that bubbles are gradually dissipate when the recording operation is completed and vibrating of the vibration plate 75 is stopped. Accordingly, in a case where vibrating of the vibration plate 75 is stopped and the bubbles are reduced to a size which is equal to or less than a limit for detecting using the detecting section 40, the state, where there is a discharge abnormality which is generated during a recording operation, is no longer detected. Accordingly, in a case where the time from stopping printing to starting checking is longer than a specific period of time, it is not possible to correctly know whether or not there is a problem in the quality of the printing material which is printed before checking.

The ink jet printer 100 and the liquid discharge state detecting method according to the present embodiment are able to more precisely ascertain the state for discharging by detecting of the state being performed before bubbles which affect discharging dissipate (are reduced to the extent that detecting is not possible) due to detecting of the state of the discharge heads 11 (the cavities 70) being performed within a specific period of time after a recording operation.

The specifics will be described below.

Timing (Specific Period of Time) for Liquid Discharge State Detecting

Figure 11:
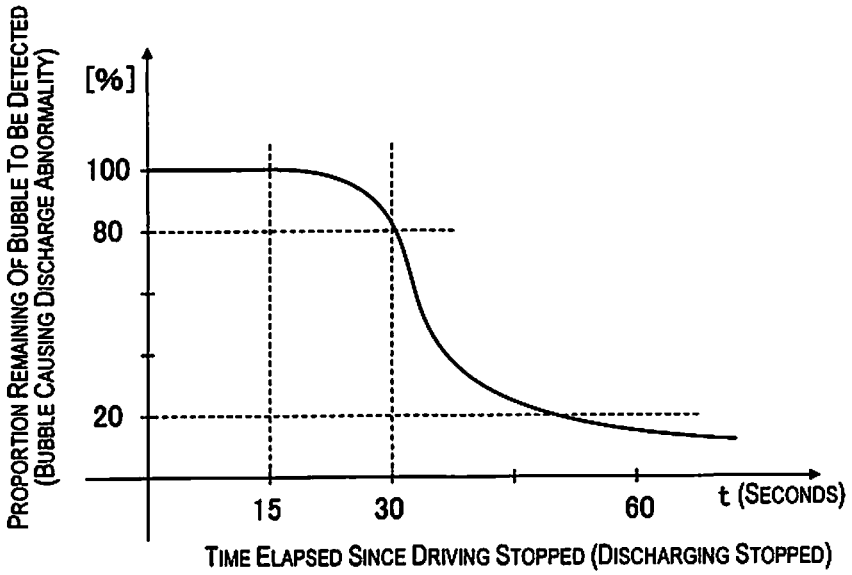
FIG. 11 is a graph of a proportion of a bubble which remains as a bubble dissipates over time.

FIG. 11 is a graph which evaluates and plots a proportion of a bubble which remains as a bubble with a size which is thought to cause discharge abnormalities during a recording operation (that is, a bubble which is included in the cavity 70 to the extent which is to be detected as abnormal using the detecting section 40) dissipates over time (time which elapses after driving of the piezoelectric element 76 is stopped) in the ink jet printer 100. Here, after driving of the piezoelectric element 76 is stopped refers to after driving of the piezoelectric element 76 in order to discharge liquid is stopped. Accordingly, it is possible for time described above to also be described as time which elapses after stopping of the discharge heads 11 discharges liquid. In the graph in FIG. 11, the vertical axis is the proportion of a bubble which remains in terms of the bubble which is to be detected (bubbles which are a cause of discharge abnormalities) and the horizontal axis is time which elapses from stopping of driving (stopping of discharging). As shown in FIG. 11, approximately 100% of the bubble remains when the elapsed time is 15 seconds but not even 20% of the bubble remains at the stage when the elapsed time is 60 seconds.

It is preferable that detecting of the liquid discharge state be performed within a specific period of time where bubbles remain to the extent which is to be detected as abnormal using the detecting section 40 and it is possible to reliably detect abnormalities, and the ink jet printer 100 detects the state in the cavities 70 using the detecting section 40 within a specific period of time under the control of the control section 50. In detail, determining is performed by the time after driving of the piezoelectric element 76 is stopped (that is, the time after the discharge heads 11 discharged the liquid) being measured under the control of the control section 50 (using a timer (FIG. 2) which is provided in the control section 50), the head driver 11*d* applying a detection drive signal to the piezoelectric element 76 at a timing up until the specific period of time elapses, the detecting section 40 observing the residual waveform, and the frequency of the residual waveform being measured.

In detail, it is preferable that the specific period of time is within 30 seconds which is when approximately 80% of the bubble remains as shown in FIG. 11 and it is more preferable that the specific period of time is within 15 seconds when the proportion of a bubble which remains is 100%. In the ink jet printer 100 of the present embodiment, the specific period of time is set as 11 second in further consideration of variation and determining is performed by the detecting section 40 observing the residual waveform after 11 second elapses and the frequency of the residual waveform being measured.

Liquid Discharge State Detection Drive Signal

The control section 50 drives the vibration plate 75 by applying a drive signal for checking to the piezoelectric element 76 via the head driver 11*d* at a timing up until the specific period of time elapses and the detecting section 40 observes the residual vibration.

It is possible to use either or both a discharge level signal or a non-discharge level signal as the drive signal for checking.

The discharge level signal is a signal which has a difference in potential and a speed for changes in potential to the extent to which ink droplets are discharged from the nozzles 71 due to driving of the piezoelectric element 76. In detail, a drive signal, which is used in a discharge operation where ink droplets are discharged and an image is formed with regard to the paper roll 2, is included as the discharge level signal. That is, observing using the detecting section 40 may be performed during discharging of ink droplets for forming of an image with regard to the paper roll 2 (that is, during a recording operation) or immediately after the last of the discharging. Here, the drive signal for checking is performed using the non-discharge level signal which is shown below since it is not possible to perform discharging of ink droplets onto the paper roll 2 in a case where observing of the state is performed with regard to the nozzles 71 which are not involved in forming of images.

The non-discharge level signal is a signal which has a difference in potential and a speed for changes in potential to the extent to which ink droplets are not discharged from the nozzles 71. The non-discharge level signal is used in a case where ink droplets are not discharged onto the recording medium (the paper roll 2) at a timing for observing the residual vibration using the detecting section 40.

Liquid Discharge State Detection Timing (Detection Location)

It is necessary that the timing with which the state in the cavities 70 is detected using the detecting section 40 be within the specific period of time described above, and for this reason, the ink jet printer 100 starts detecting of the state of the discharge heads 11 while the driving roller 13 is moving the paper roll 2 in the first region (the region where an image is formed on the paper roll 2 using the discharge heads 11). That is, since there is a concern that the specific period of time will elapse while starting the detecting after moving of the paper roll 2 when the paper roll 2 is moved (a paper feeding or housing operation) after a desired recording operation is completed, detecting is started without waiting for moving of the paper roll 2 to be completed.

In addition, since there is a concern that the specific period of time will elapse while starting the detecting after moving the discharge heads 11 to the second region also in a case where a recording operation is stopped and the discharge heads 11 are moved to the second region in order to perform maintenance which is necessary, detecting is started in the first region without waiting for moving of the discharge heads 11 to the second region to be completed.

Here, it is not sufficient if the time until detecting is started is short as long as it is within the specific period of time and it is preferable that the time until detecting is started be appropriately set along with a threshold for detecting abnormalities.

Figure 12:
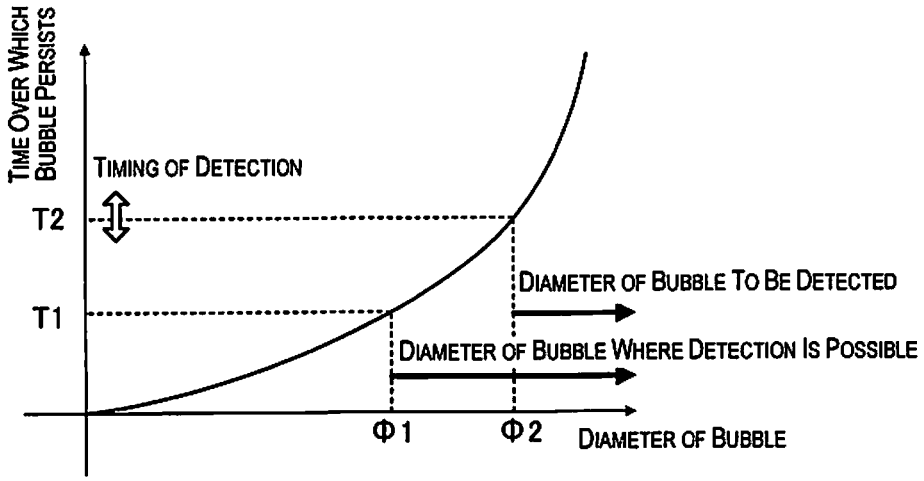
FIG. 12 is a graph illustrating the relationship of the diameter of bubbles and time over which a bubble persists.

FIG. 12 is a graph illustrating the relationship of the diameter of bubbles and time over which a bubble persists.

As shown in FIG. 12, it is necessary for the timing for detecting to be earlier in a case where there is a desire to detect smaller bubbles since the time over which a bubble persists is shorter as the diameter of the bubbles is smaller, but there are cases where an abnormality is detected even if there are small bubbles which can be ignored (bubbles with a diameter of $\phi$1 to $\phi$2 in FIG. 12) if the checking is carried out at a timing which is too early. In FIG. 12, $\phi$1 is the diameter which is the limit for detecting and $\phi$2 is the smallest diameter of the bubbles which are to be detected. In this case, it is possible to appropriately perform detecting by adjusting the threshold (adjusting detection sensitivity). In addition, it is possible to appropriately perform detecting in the same manner by, alternatively, delaying the timing for detecting (from T1 to T2) without change the threshold.

As described above, it is possible to obtain the following effects using the liquid discharge apparatus and the liquid supply path state detecting method according to the present embodiment.

The ink jet printer 100 is provided with the discharge heads 11 which discharge the ink 1 which is filled into the cavities 70 from the nozzles 71 which is linked with the cavities 70 due to the capacity of the cavities 70 changing according to vibrating of the vibration plate 75 which is vibrated by the piezoelectric element 76, the driving head 11*b* which drives the piezoelectric element 76, and the detecting section 40 which detects the state of the discharge heads 11. In addition, in a case where any fault is generated in the discharge heads 11 while the piezoelectric element 76 is being driven (when the discharge heads 11 are discharging the ink 1), it is possible to detect the state within a certain range over which the circumstances of the fault change since the detecting section 40 detects the state of the discharge heads 11 within a specific period of time (a specific period of time after the ink 1 is discharged) after driving of the piezoelectric element 76 is stopped. As a result, it is possible to more precisely detect the state of the discharge heads 11 by detecting the state of the discharge head 11 within a specific period of time before there are changes to a state where detection of the fault is no longer possible.

In addition, it is possible to simply estimate the extent of the bubbles which are included in the cavities 70 since the detecting section 40 detects the state of the discharge heads 11 based on the residual vibration in the vibration plate 75. Since there is a detecting means where observing of the residual vibration of the vibration plate 75 is performed relatively quickly, it is possible for the detecting section 40 to simply perform detecting of the state of the discharge heads 11 (in particular, a state where bubbles have an effect) within a specific period of time after driving of the piezoelectric element 76 is stopped or after the discharge heads discharge the ink 1.

In addition, due to the detecting section 40 detecting the state of the discharge heads 11 within 30 seconds (after 11 seconds) after driving of the piezoelectric element 76 is stopped or after the discharge heads 11 discharge the ink 1, it is possible for the ink jet printer 100 to more precisely detect the state of the discharge heads 11 before of an abnormality which is generated in the discharge heads 11 dissipates.

In addition, the ink jet printer 100 is provided with the driving roller 13 which moves the paper roll 2. The detecting section 40 starts detecting the state of the discharge heads 11 while the driving roller 13 is moving the paper roll 2. That is, since detecting of the state of the discharge heads 11 is started before moving of the paper roll 2 is complete, it is possible for it to be easy to detect this state before an abnormality which is generated in the discharge heads 11 dissipates.

In addition, it is possible for the discharge heads 11 to move between the first region where the ink 1 is discharged onto the paper roll 2 where the ink 1 is discharged and the second region where the ink 1 is not discharged onto the paper roll 2. The detecting section 40 starts detecting the state of the discharge heads 11 while the discharge heads 11 are positioned in the first region. That is, detecting of the state of the discharge heads 11 is started before moving of the discharge heads 11 is complete in a case such as when, for example, a recording (printing) operation is stopped and the discharge heads 11 are moved to the second region in order to perform maintenance on the discharge heads 11. That is, since detecting of the state of the discharge heads 11 is started in the first region after the discharge heads 11 discharge the liquid in the first region, it is possible for it to be easy to detect this state before an abnormality which is generated in the discharge heads 11 dissipates.

As above, according to the ink jet printer 100, it is possible to more precisely detect and deal with faults since a detecting means is provided which is able to detect the discharge state before it is no longer possible to detect the discharge abnormality due to bubbles or the like.

Here, the present invention is not limited to the embodiment described above and it is possible to add various modifications, alterations, and the like to the embodiment described above. Modified examples will be described below. Here, the constituent elements which are the same as in the embodiment described above will use the same reference numerals and overlapping description will be omitted.

Modified Example 1

A printer with a line head system, where the discharge heads 11 are aligned to be fixed in the width direction of the paper roll 2, is described as an example in embodiment 1. It is possible to also refer to a printer with a line head system as a liquid discharge apparatus where recording (printing) is performed by discharging a liquid onto a recording medium while the recording medium is being moved. However, the liquid discharge apparatus is not limited to a printer with a line head system. For example, the liquid discharge apparatus may be a printer with a serial head system where recording is performed by discharging the ink 1 while the discharge section (the discharge heads 11) is being moved to scan in the width direction of the paper roll 2 which intersects with the transfer direction of the paper roll 2. It is possible to also refer to the printer with a serial head system as a liquid discharge apparatus where recording (printing) by discharging a liquid with regard to the recording medium and moving of the recording medium are alternately repeated.

An ink jet printer 101 according to the present modified example (which is not shown in the diagrams) is a printer with a serial head system and is provided with the discharge heads 11, head units 19*s* which are configured using two of the discharge heads 11, and a discharge section moving section (which is not shown in the diagrams) which moves the discharge heads 11 (the head units 19*s*) in a head scanning direction (the width direction of the paper roll 2) which is a "second direction" which intersects with the transfer direction of the paper roll 2 which is a "first direction" (in the –X direction). In other words, the liquid discharge apparatus is provided with the discharge section moving section which moves the discharge section.

Figure 13:
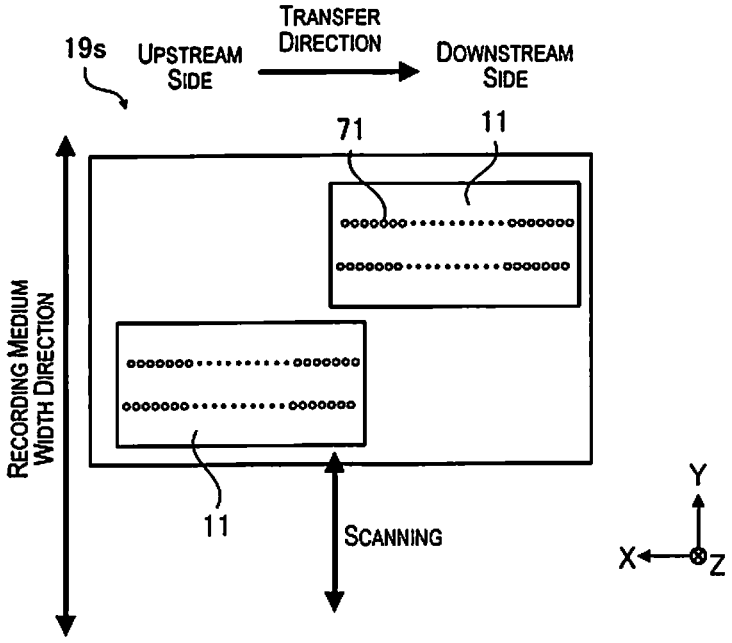
FIG. 13 is a planar diagram illustrating an example of a head unit in modified example 1.

FIG. 13 is a planar diagram illustrating an example of the head unit 19*s* and the head unit 19*s* is shown in a state viewed from the lower surface of the head unit 19*s*.

The head unit 19*s* is provided with two of the discharge heads 11 which are arranged in a direction so that the nozzles 71 line up in the X axis direction as shown in FIG. 13. Recording is performed to span across the entire width direction of the paper roll 2 by the head units 19*s* discharging the ink 1 while scanning in the Y axis direction (the width direction of the paper roll 2) using the discharge section moving section.

In addition, moving of the paper roll 2 to the second region (a region for maintenance or the like) where the ink 1 is not discharged is performed by the discharge heads 11 being moved from a region, where the discharge heads 11 overlap with the paper roll 2, more to the outer side in the second direction using the discharge section moving section.

In addition, the ink jet printer 101 is provided with the detecting section 40 and it is possible for the detecting section 40 to start detecting the state of the discharge heads 11 while the discharge section moving section is moving the discharge heads 11 in the head scanning direction. In other words, the detecting section 40 starts detecting the state of the discharge section while the discharge section moving section is moving the discharge section.

Except for this point, the ink jet printer 101 is the same as the ink jet printer 100.

In a case where any fault is generated in the discharge heads 11 while the piezoelectric element 76 is being driven (when the discharge heads 11 are discharging the ink 1), it is possible to detect the state within a certain range over which the circumstances of the fault change by the detecting section 40 detecting the state of the discharge heads 11 within the specific period of time (the specific period of time after the ink 1 is discharged) after driving of the piezoelectric element 76 is stopped in the same manner as embodiment 1. In addition, it is possible for the detecting section 40 to start detecting the state of the discharge heads 11 while the discharge section moving section is moving the discharge heads 11 in the head scanning direction. That is, since detecting of the state of the discharge heads 11 is started before moving of the discharge heads 11 to the maintenance region is complete, it is possible for it to be easy to detect this state before an abnormality which is generated in the discharge heads 11 dissipates.

Modified Example 2

There is the description in the embodiment 1 where it is preferable that the specific period of time is within 30 seconds and it is more preferable that the specific period of time is within 15 seconds due to the proportion of a bubble which remains, the specific period of time is set as 11 second in further consideration of variation and determining is performed by the detecting section 40 observing the residual waveform after 11 second elapses and the frequency of the residual waveform being measured, but the specific period of time is not limited to being the period of time using this determining method and there may be a determining method which, for example, depends on the remaining volume of bubbles.

In the present applied example, the specific period of time is a period of time over which the volume of bubbles which are included in the cavities 70 while the head driver 11*d* is driving the piezoelectric element 76 (while the discharge heads 11 are discharging the ink 1) are reduced by half after driving of the piezoelectric element 76 is stopped (after the discharge heads 11 discharge the ink 1).

By the detecting section 40 setting the threshold so that it is possible to detect bubbles with a volume which is half of the volume of bubbles to the extent which causes abnormalities in the discharge heads 11 (that is, bubbles which are to be detected as abnormalities), it is possible for the detecting section 40 to precisely detect abnormalities which are generated in the discharge heads 11 before this state dissipates.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid discharge apparatus comprising:

a discharge section configured to discharge a liquid which is filled into a cavity from a nozzle linked with the cavity, due to capacity of the cavity changing according to vibrating of a vibration plate which is vibrated by a piezoelectric element;

a driving section configured to drive the piezoelectric element; and a detecting section configured to detect a state of the discharge section, the detecting section being configured to detect the state of the discharge section between 11 to 30 seconds after driving of the piezoelectric element is stopped.

2. The liquid discharge apparatus according to claim 1, wherein the detecting section being configured to detect the state of the discharge section between 11 to 15 seconds after driving of the piezoelectric element is stopped.

3. The liquid discharge apparatus according to claim 1, wherein the detecting section is configured to detect the state of the discharge section based on residual vibration in the vibration plate.

4. The liquid discharge apparatus according to claim 1, further comprising a recording medium moving section configured to move a recording medium, wherein the detecting section is configured to start detecting the state of the discharge section while the recording medium moving section is moving the recording medium.

5. The liquid discharge apparatus according to claim 1, wherein the discharge section is further configured to move between a first region where the liquid is discharged onto a recording medium where the liquid is discharged and a second region where the liquid is not discharged onto the recording medium, and the detecting section is configured to start detecting the state of the discharge section while the discharge section is positioned in the first region.

6. The liquid discharge apparatus according to claim 1, further comprising a discharge section moving section configured to move the discharge section, wherein the detecting section is configured to start detecting the state of the discharge section while the discharge section moving section is moving the discharge section.

7. A liquid discharge apparatus comprising:

a discharge section configured to discharge a liquid which is filled into a cavity from a nozzle linked with the cavity, due to capacity of the cavity changing according to vibrating of a vibration plate which is vibrated by a piezoelectric element;

a driving section configured to drive the piezoelectric element; and a detecting section configured to detect a state of the discharge section, the detecting section being configured to detect the state of the discharge section within a specific period of time after driving of the piezoelectric element is stopped, wherein the specific period of time is a period of time over which a volume of a bubble which is included in the cavity while the driving section is driving the piezoelectric element is reduced by half after driving of the piezoelectric element is stopped.

8. A liquid discharge state detection method where a state of a discharge section is detected in a liquid discharge apparatus, which includes the discharge section configured to discharge a liquid which is filled into a cavity from a nozzle linked with the cavity, due to capacity of the cavity changing according to vibrating of a vibration plate which is vibrated by a piezoelectric element, and a driving section configured to drive the piezoelectric element, the method comprising:

detecting the state of the discharge section between 11 to 30 seconds after driving of the piezoelectric element is stopped or the discharge section discharges the liquid.

* * * * *